United States Patent [19]

Grafen

[11] 4,403,379

[45] Sep. 13, 1983

[54] CHAIN FOR A TENTER FRAME WITH TENTERING CLAMPING AND NEEDLE COMBINATION LINKS

[75] Inventor: Karl Grafen, Wuerselen, Fed. Rep. of Germany

[73] Assignee: H. Krantz GmbH & Co., Aachen, Fed. Rep. of Germany

[21] Appl. No.: 295,709

[22] Filed: Aug. 24, 1981

[30] Foreign Application Priority Data

Sep. 4, 1980 [DE] Fed. Rep. of Germany ..... 3033271

[51] Int. Cl.[3] ..... D06C 3/04

[52] U.S. Cl. ..... 26/95; 26/79

[58] Field of Search ..... 26/79, 95

[56] References Cited

FOREIGN PATENT DOCUMENTS 1004530 11/1951 France ..... 26/95

*Primary Examiner*—Robert Mackey

*Attorney, Agent, or Firm*—W. G. Fasse; D. H. Kane, Jr.

[57] ABSTRACT

A chain for a tentering frame includes links which carry so-called tentering hooks and needles for holding a fabric web to a movable conveyor forming the tentering frame. Each link (9) carries an intermediate support member (7) which holds at its free end a journal pin (3) below the margin of a fabric web (1). The journal pin (3) supports an arched bail (2) in a tiltable manner for movement between a working position and a rest position. The bail carries at its upper free end a further journal pin (12) which supports a tentering hook (10) in a tiltable manner. The first journal pin (3) further supports a needle bar (13) which is tiltable with its needles into a fabric penetrating position or into an inoperative position. The needle bar (13) preferably has a flat surface which cooperates with the tentering hooks (10) as a counter-holder when the needles are in a rest position.

5 Claims, 3 Drawing Figures

CHAIN FOR A TENTER FRAME WITH TENTERING CLAMPING AND NEEDLE COMBINATION LINKS

CROSS-REFERENCE TO RELATED APPLICATION

The present application corresponds to German Patent Application No. P 3,033,271.9, filed in the Federal Republic of Germany on Sept. 4, 1980. The priority of said German filing data is hereby claimed.

BACKGROUND OF THE INVENTION

The invention relates to a chain for a tenter frame for vertical chain reversal with tentering clamp and needle combination links for gripping the margins of a continuous sheet or web of fabric, whereby each tentering clamp member has a tentering knife which is hinged on a journal pin located above the plane of the continuous web of cloth or fabric. The journal pin extends in parallel to the margin of the web and is secured in the upper end of an arched supporting bail. Each needle member includes a needle bar which is hinged on a journal pin supported below the plane of the continuous web, parallel to the web margin, in the lower end of the arched supporting bail.

Tenter frame chains for a vertical chain reversal with tentering clamp and needle combination links, are used in so-called horizontal hot air tentering frames. Such chains also enable a further standardization of the guiding of the chains in single layer tenter frames.

Tenter frame chains equipped with tentering clamp and needle combination links which enable a vertical chain reversal are known. These combination chains utilize so-called hammer-type tentering clamps for the clamping action, which have the drawback that their clamping action is limited and that an exact clamping width is not certain as is the case with the so-called roller probing tentering devices.

OBJECTS OF THE INVENTION

In view of the above, it is the aim of the invention to achieve the following objects singly or in combination:

to provide a tenter frame chain for vertical chain reversal with tentering clamp and needle combination links which has a better clamping effect for its tentering action compared to hammer-type tentering clamps;

to construct the clamp and needle combination link so that it provides a tenter width exactness comparable to that of tentering clamps with roller sensors;

to avoid the disadvantages of the hammer-type clamp tentering chain by using the roller sensor principle for the clamping means;

to spring bias a support bail so that it may take up a clamp work position or a needle work position;

to make the needle bar usable as a clamp support; and to avoid chattering when the clamping means move out of the working position.

SUMMARY OF THE INVENTION

According to the invention, a chain for a tenter frame is characterized in that the arched supporting bail (2), which is hinged on the lower journal pin (3) held in an intermediate member (7) which is secured to a chain link (9), swings the tentering clamping members into the working position in such a way that a plane passing through the central axes of both journal pins (3, 12) crosses the plane of the continuous web (1) so that the line of intersection has a larger spacing from the respective margin of the continuous web (1) than the clamping line caused by the tentering knife (10) on the web margin and that the arched supporting structure (2) which is hinged on the lower pin (3) swings the needle members into their working position in such a way that a plane passing through the central axes of both journal pins (3, 12) passes on the outside of the continuous web (1) and that the needle bar (13) is hinged on the lower journal pin (3) in such a way that the needle members can penetrate the respective margins of the continuous web of cloth (1).

The drawbacks of a combination hammer-type tentering device are eliminated in the present tenter frame chain by utilizing roller sensor principles. The application of roller sensor principle is made possible according to the invention by the arched supporting bail which carries the tentering knife and which may be swung into two positions due to being hinged on a lower journal pin held by an intermediate member which is connected to a chain link, whereby the cloth or fabric, in effect, may be clamped or declamped.

The clamping effect on the material web to be clamped and tentered, increases as the tension on the fabric increases because of the position of the clamping line between the clamping knife or tenter hook and the clamping base or table at a spacing from the imaginary connecting line between the hinge axes. The tentered width or the clamping width is determined by the spacing between the clamping line and the tentering or clamping roller. For the needle operation, the arched supporting bail may be swiveled back about the lower journal pin to such an extent that a plane passing through the central axes of both journal pins extends outside of the continuous web of cloth or fabric and cannot hinder the swiveling operation of the needle bar about the lower pin.

According to one example embodiment of the invention, a bow spring is secured with one end to an intermediate member and with the other end to the arched supporting bail. The bow spring is arranged so that after surpassing the dead center, the arched supporting bail may be held against the bearing surfaces provided on the intermediate member for selecting the tentering hook effective position or the working position of the needles.

A further example embodiment of the invention provides that in the working position of the tentering hooks or clamps, the needle bar is tiltable out of the needle working position by 90° in such a way that after the tilting motion, the needles point toward the arched supporting bail and so that a now horizontal lateral face of the needle bar forms a supporting table for the tentering knife. This embodiment allows the needle bar to be used as the tentering table in the working position of the tentering hook.

In a further embodiment of the invention, another spring is secured to the intermediate member so that the free end of the spring which is bent in the shape of a semi-circle, butts against the tilted back tentering knife in the needle working position. This example embodiment, according to the invention, eliminates a rattling or chattering of the tentering knife in a non-working position, since the spring, behind which the tentering knife lays itself, secures the knife.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
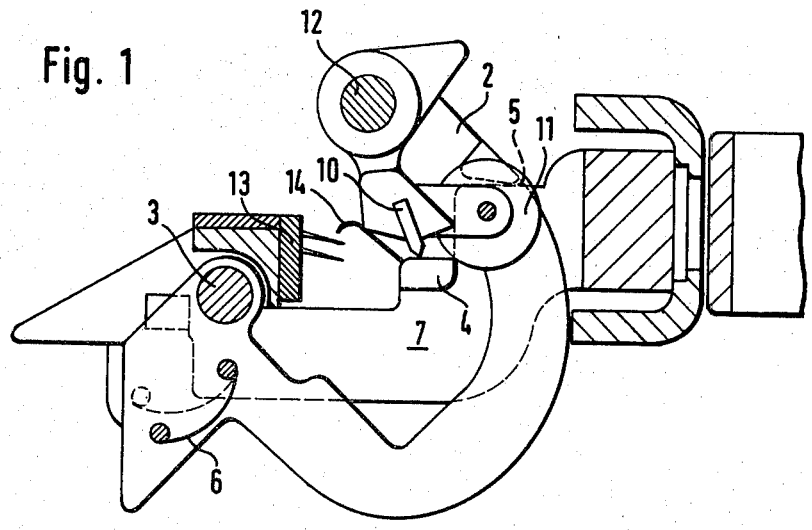
FIG. 1 shows the tentering hook or clamp and needle combination link with its tentering knife swung back and a needle bar not yet in its operating position.
Figure 2:
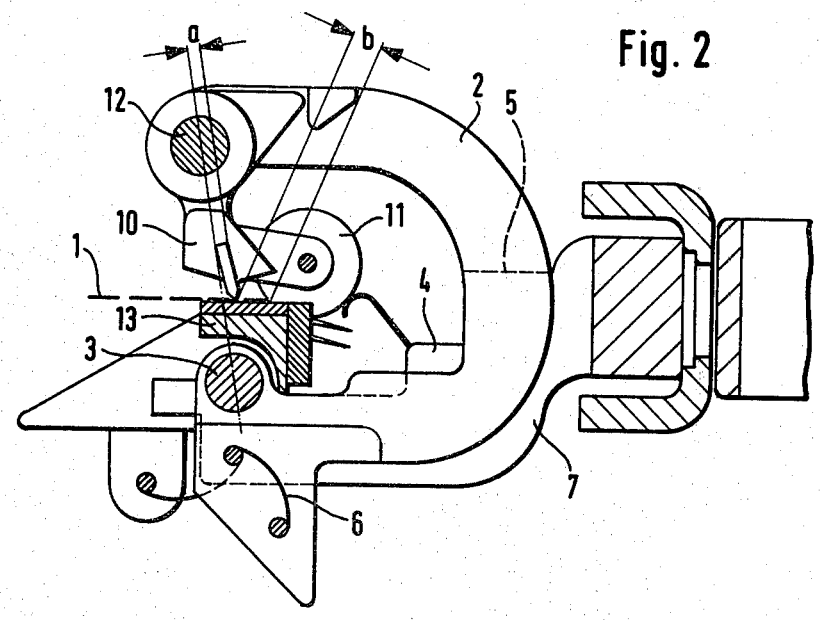
FIG. 2 shows the tentering hook or clamp and needle combination link with the tentering hook in its working position.

The clamping and declamping of a continuous web of cloth of fabric 1 is achieved with the aid of an arched supporting bail 2 which is journaled to a lower journal pin 3 for movement from the clamping position illustrated in FIG. 2 to the declamped position shown in FIG. 1. Stops 4 and 5 limit the end positions of the arched supporting bail 2 which is held in each of the end position by a bow spring 6.

The journal pin 3 is supported in an intermediate piece 7 which is connected to a roller chain link 9 by screw means 8.

A tentering knife 20 with a sensing roller 11 is hinged on a further, upper journal pin 12 which is secured in the upper portion of the arched supporting bail 2. A clamping line is produced between the tentering knife 10 and a supporting table 13 at a spacing "a" to the right of the imaginary connecting line between the journal pins 3 and 12. The clamping action on the cloth web 1, to be tentered, is increased due to this position of the clamping line in response to an increase in the tension on the cloth or fabric. The tenter or clamping width is determined by the spacing "b" between the above described clamping line and the sensing roller 11.

Figure 3:
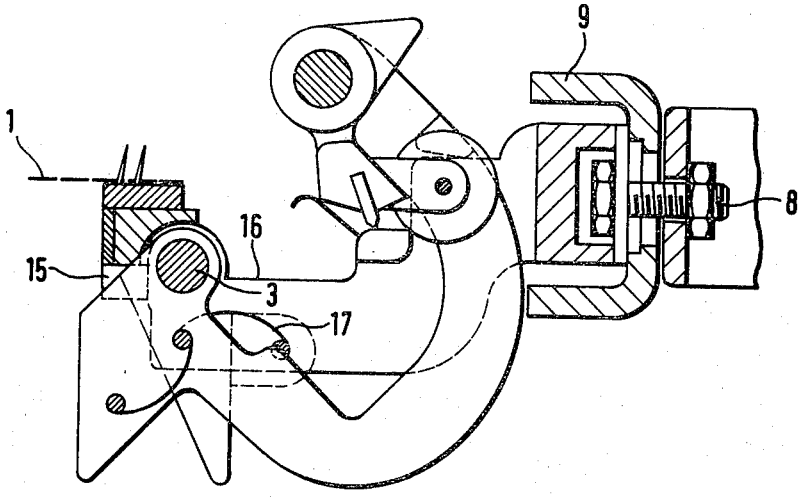
FIG. 3 shows the tentering hook or clamp and needle combination link with the needles in their working position.

To prevent a rattling or chattering of the tentering knife 10 in its tilted-back position, a spring 14 is provided, behind which the tentering knife 10 lays itself as shown in FIGS. 1 and 3.

In the needle working position according to FIG. 3, the arched supporting bail 2 is in the same position as illustrated in FIG. 1. The supporting table 13, formed as a needle bar, is swiveled or journaled about the lower pin 3 by 90° so that the needles come into the proper upright position to penetrate the continuous web of cloth or fabric 1.

The end positions of the combination clamping table and needle bar 13 are determined by the bearing surfaces or stop members 15 and 16, whereby a spring clip 17 fixes the needle bar and supporting table 13 in each of the end positions.

Although the invention has been described with reference to specific example embodiments, it will be appreciated that it is intended to cover all modifications and equivalents within the scope of the appended claims.

What is claimed is:

1. A chain structure for a tenter frame for substantially vertical chain reversal, comprising chain link means, intermediate support means (7) having a first free end and a second end secured to said chain link means, arched bail means (2), first lower journal means (3) extending below and in parallel to a margin of a fabric web for journaling a lower end of said bail means (2) to said first free end of said intermediate support means (7) for tilting said bail means between a working position and a rest position, tenter hook means (10), second upper journal means (12) extending above and in parallel to a margin of a fabric web for journaling said tenter hook means (10) to said bail means (2) at the upper free end thereof, wherein said arched bail means (2) is tiltable about said lower journal pin (3) in such a manner that a plane extending through both journal means (3, 12) intersects a fabric web at a given spacing from the respective margin of a fabric web (1), said tentering hook means (10) producing on the fabric margin a clamping line which is located within said given spacing, said chain structure further comprising needle means, needle bar means (13), for operatively supporting said needle means, said needle bar means being journaled to said first lower journal means (13) for tilting said needle bar means between an inoperative position and an operative position in which the needle penetrates a margin of a fabric web, said arched bail means (2) being tiltable into said rest position in which said plane extending through both journal means passes outside a fabric web for permitting said tilting of the needle bar means into an operative position in which said needle means penetrate a fabric web (1).

2. The structure of claim 1, further comprising bow spring means (6), means securing one end of said bow spring means to said intermediate support means, further means securing the other end of said bow spring means to said arched bail means (2) for selectively holding the arched bail means (2) in said working position or in said rest position upon overcoming a dead center point whereby either the tentering hook means (10) or the needle means are in an operative position.

3. The structure of claim 1 or 2, wherein said needle bar means (13) comprise a flat support member which constitutes a supporting table for cooperation with said tentering hook means (10) when the tentering hook means are in the operative position and the needle means are in the inoperative position in which said needle means point substantially toward said arched bail means (2), said flat support member being in an inoperative position when said needle means are in an operative position.

4. The structure of claim 3, comprising further spring means (14) operatively secured to said intermediate support means (7) in such a position that said tentering hook means (10) are held in the rest position by said further spring means (14), whereby chattering by the tentering hook means (10) in their rest position is prevented by said further spring means.

5. The structure of claim 1 or 2, further comprising spring means (14) operatively secured to said intermediate support means (7) in such a position that said tentering hook means (10) are held in the rest position by said spring means (14), whereby chattering by the tentering hook means (10) in their rest position is prevented by said spring means (14).

* * * * *